US007284369B2

(12) United States Patent
Nakano et al.

(10) Patent No.: US 7,284,369 B2
(45) Date of Patent: Oct. 23, 2007

(54) SECONDARY AIR SUPPLY SYSTEM AND FUEL INJECTION AMOUNT CONTROL APPARATUS USING THE SAME

(75) Inventors: Tomoaki Nakano, Nagoya (JP); Yuuki Sakamoto, Kariya (JP)

(73) Assignee: Denso Corporation, Kariya, Aichi-pref. (JP)

( * ) Notice: Subject to any disclaimer, the term of this patent is extended or adjusted under 35 U.S.C. 154(b) by 336 days.

(21) Appl. No.: 11/020,156

(22) Filed: Dec. 27, 2004

(65) Prior Publication Data

US 2005/0138919 A1 Jun. 30, 2005

(30) Foreign Application Priority Data

Dec. 26, 2003 (JP) ..... 2003-432626
Feb. 12, 2004 (JP) ..... 2004-034741
Apr. 28, 2004 (JP) ..... 2004-133362
Apr. 28, 2004 (JP) ..... 2004-133363

(51) Int. Cl.
*F01N 3/00* (2006.01)

(52) U.S. Cl. ..... 60/289; 60/276; 60/277; 60/285

(58) Field of Classification Search ..... 60/274, 60/276, 277, 285, 289, 293
See application file for complete search history.

(56) References Cited

U.S. PATENT DOCUMENTS 4,123,904 A * 11/1978 Nonoyama et al. ..... 60/290
5,782,086 A * 7/1998 Kato et al. ..... 60/274
5,852,929 A * 12/1998 Kato et al. ..... 60/274
6,023,401 A * 2/2000 Hashimoto et al. ..... 361/93.1
6,155,043 A * 12/2000 Zhang et al. ..... 60/284
6,918,245 B2 * 7/2005 Hirooka et al. ..... 60/289
6,983,590 B2 * 1/2006 Roelle et al. ..... 60/289
7,222,483 B2 * 5/2007 Oi et al. ..... 60/289
2003/0061805 A1 4/2003 Hirooka et al. ..... 60/289
2005/0274109 A1 * 12/2005 Nakata et al. ..... 60/289

FOREIGN PATENT DOCUMENTS

JP 2002-227639 8/2002

* cited by examiner

*Primary Examiner*—Tu M. Nguyen
(74) *Attorney, Agent, or Firm*—Nixon & Vanderhye P.C.

(57) ABSTRACT

A secondary air pipe is connected on the upstream side from catalyst in an exhaust pipe, and a secondary air pump is provided at an upstream portion of the secondary air pipe. An opening/closing valve for opening/closing the secondary air pipe is provided on the downstream side from the secondary air pump. A pressure sensor for detecting pressure within pipe is provided between the secondary air pump and the opening/closing valve. An ECU calculates a secondary airflow rate based upon difference pressure between both secondary air supply pressure which is detected by the pressure sensor when the opening/closing valve is opened under such a condition that the secondary air pump is operated, and also, shutoff pressure which is detected by the pressure sensor when the opening/closing valve is closed.

12 Claims, 10 Drawing Sheets

SECONDARY AIR SUPPLY SYSTEM AND FUEL INJECTION AMOUNT CONTROL APPARATUS USING THE SAME

CROSS-REFERENCE TO RELATED APPLICATION

This application is based on Japanese Patent Applications No. 2003-432626 filed on Dec. 26, 2003, No. 2004-34741 filed on Feb. 12, 2004, No. 2004-133362 filed on Apr. 28, 2004 and No. 2004-133363 filed on Apr. 28, 2004, the disclosures of which are incorporated herein by reference.

FIELD OF THE INVENTION

The present invention generally relates to a secondary air supply system of an internal combustion engine, and a fuel injection amount control apparatus using the secondary air supply system.

BACKGROUND OF THE INVENTION

Exhaust gas purifying apparatus such as catalyst are provided in exhaust gas pipes of internal combustion engines in order to purify exhaust gas. Various technical ideas for supplying secondary air to upstream sides of these exhaust gas purifying apparatus have been proposed in order to improve purification efficiencies of the exhaust gas purifying apparatus. If secondary air is not normally supplied, then purification efficiencies of exhaust gas purifying apparatus are lowered, which may deteriorate exhaust emission. As a result, various technical ideas capable of detecting abnormal statuses of secondary air supply systems have also been proposed.

For instance, in JP-9-21312A (corresponding to U.S. Pat. No. 5,852,929), while the pressure sensor is installed in the secondary air passage, the abnormal condition of the secondary air supply system is detected based upon the detection value of the pressure sensor under such a condition that the secondary air pump is operated. In JP-2003-83048A (corresponding to US-2003-0061805A1), the malfunction modes of the respectively structural components of the secondary air supply system are detected based upon combinations of pressure behavior patterns when the secondary air is supplied, and also, when supplying of the secondary air is stopped.

In order to properly manage exhaust gas amounts of exhaust emissions, there are necessities to detect secondary airflow rates. However, in such secondary air supply systems as described in the above-described publications, it is practically difficult to detect the secondary airflow rate in high precision. In other words, in the conventional secondary air supply systems, the pressure (namely, secondary air supply pressure) at the air output ports of the secondary air pump is basically detected, and then, such a calculation method for calculating the secondary airflow by employing the detected secondary air suppress pressure may be conceived. However, when this calculation method is conducted, there is a problem that the calculation precision as to the secondary airflow rate is deteriorated due to tolerance (fluctuations of performance etc.) of products. When the secondary air pump is constituted by DC motor, or the like, there is certain product tolerance (fluctuations of performance etc.) in the secondary air pump. In addition, pipe pressure loss may be produced in second air pipe through which secondary air flows. The pressure sensor also owns individual differences and tolerance. These factors may cause another problem that the calculation precision of the secondary airflow rate is deteriorated.

SUMMARY OF THE INVENTION

The invention has been made to solve the above-described problems of the conventional techniques, and therefore, has an object to provide a secondary air supply system of an internal combustion engine, capable of calculating a secondary airflow rate in higher precision, and capable of contributing an improvement in exhaust emission.

In the secondary air supply system of the invention, a secondary airflow rate is calculated based upon both secondary air supply pressure and reference pressure. The secondary air supply pressure is detected by a pressure sensor under such a predetermined secondary air supply condition that a secondary air supply apparatus is operated and also an opening/closing valve is opened. The reference pressure is detected by the pressure sensor under another condition different from the secondary air supply condition. In this case, since the secondary airflow rate is calculated by employing not only the secondary air supply pressure but also the reference pressure, even when product tolerance owned by the secondary air supply apparatus and product tolerance owned by the pressure sensor are presented, the calculation precision of the secondary airflow rate can be enhanced. In other words, while the secondary air supply apparatus and the pressure sensor own the product tolerance to some extent as industrial products, if the secondary airflow rate is calculated based upon such a secondary air supply pressure detected as absolute pressure, then a calculation error caused by the product tolerance and the like are produced. In contrast thereto, in accordance with the invention, since the secondary air supply pressure is converted into relative pressure so as to calculate the secondary airflow rate, the secondary airflow rate can be calculated by absorbing the product error. As a consequence, the secondary airflow rate can be calculated in higher precision, which may contribute to improve the exhaust emission.

Also, in accordance with the invention, both the pressure within the secondary air passage and the pressure within the exhaust passage are detected respectively, and then, the secondary airflow rate is calculated based upon both the detected pressure. In this case, since the secondary airflow rate is calculated by employing not only the pressure within the secondary air passage, but also the pressure within the exhaust passage, even when the pressure within the exhaust passage is changed which is caused due to change of the drive condition of the internal combustion engine, the secondary airflow rate can be calculated in higher precision. As a consequence, the exhaust emission can be improved.

BRIEF DESCRIPTION OF THE DRAWINGS

Other objects, feature and advantages of the present invention will become more apparent from the following detailed description made with reference to the accompanying drawings, in which like parts are designated by like reference numbers and in which.

DETAILED DESCRIPTION OF EMBODIMENTS

First Embodiment

Figure 1:
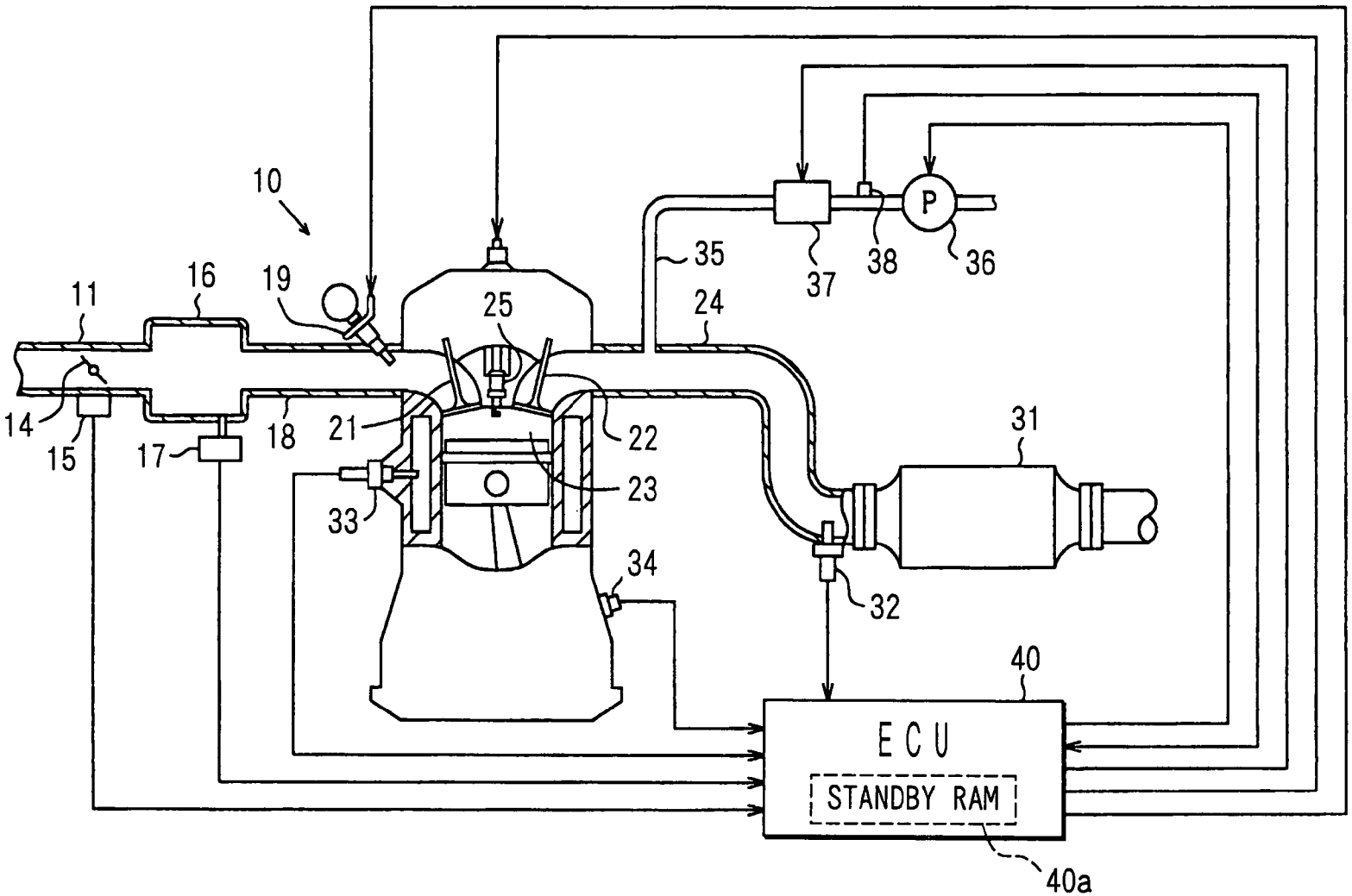
FIG. 1 is a structural diagram for schematically showing an engine control system according to a first embodiment of the invention.

A first embodiment of the present invention is described hereinafter with reference to drawings. In this first embodiment, it is so assumed that an engine control system directed to an on-vehicle multiple cylinder gasoline engine corresponding to an internal combustion engine is constituted, and in this engine control system, an electronic control unit (will be referred to as an "ECU" hereinafter) is employed as a major unit so as to control a fuel injection amount and also to control ignition timing. FIG. 1 is an entire schematic structural diagram of the engine control system.

An engine 10 is provided with a throttle valve 14 and a throttle open degree sensor 15 in an air intake pipe 11. An open degree of the throttle valve 14 is controlled by an actuator such as a DC motor. The throttle open degree sensor 15 senses a throttle open degree. While a surge tank 16 is provided on the downstream side of the throttle valve 14, an intake pipe pressure sensor 17 for detecting intake pipe pressure is provided in this surge tank 16. An intake manifold 18 is connected to the surge tank 16 to introduce an air to each of the cylinders of the engine 10. A fuel injection valve 19, which is electromagnetically driven, for injecting a fuel into the cylinder is mounted in the intake manifold 18 in the vicinity of an air intake port of each of the cylinders.

An intake valve 21 and an exhaust valve 22 are provided at an air intake port and an exhaust port of the engine 10. A gas mixture of the air and the fuel is sucked to a combustion chamber 23 by an opening operation of the intake valve 21, and exhaust gas produced after combustion operation is exhausted to an exhaust pipe 24 by an opening operation of the exhaust valve 22. An ignition plug 25 is mounted on a cylinder head of the engine 10 every cylinder. A high voltage is applied to the ignition plug 25 at desirable ignition timing via an ignition apparatus (not shown) which is constructed of an ignition coil and the like. Since this high voltage is applied to each of the ignition plugs 25, a sparking discharge is produced between opposite electrodes of each of the ignition plugs 25, so that the gas mixture in the combustion chamber 23 is ignited and burned.

A catalyst 31, such as three-way catalyst, purifying CO, HC, NOx contained in the exhaust gas is provided in the exhaust pipe 24. An air-fuel sensor 32, such as a linear A/F sensor and an $O_2$ sensor, is provided on the upstream side of this catalyst 31, and this air-fuel sensor 32 detects an air-fuel ratio of the exhaust gas, which is indicative of the air-fuel ration of the gas mixture. A coolant temperature sensor 33 and a crank angle sensor 34 are mounted on an engine block of the engine 10. The coolant temperature sensor 33 senses a temperature of coolant. The crank angle sensor 34 outputs a rectangular crank angle signal every predetermined crank angle (for example, in 30-degree CA period).

A secondary air pump 35, which comprises a secondary air supply system, is connected to the exhaust pipe 24 on the upstream side from the catalyst 31. A secondary air pump 36, which comprises the secondary air supply system, is provided at an upstream portion of this secondary air pipe 35. The secondary air pump 36 is constructed of, for instance, a DC motor, and is operated by receiving electric power supplied from an on-vehicle battery (not shown). Also, an opening/closing valve 37 is provided on the downstream side from the secondary air pump 36 in order to open/close the secondary air pipe 35. A pressure sensor 38 is provided for sensing pressure within the secondary air pipe 35 between the secondary air pump 36 and the opening/closing valve 37.

Sensor outputs of the sensors described above are input to an ECU (electronic control unit) 40 for controlling the engine 10. The ECU 40 includes a microcomputer which is comprised of a CPU, a ROM, a RAM, and the like. Since the ECU 40 executes various sorts of control programs which have been stored in the ROM, the ECU 40 controls a fuel injection amount of the fuel injection valve 19 and ignition timing by the ignition plug 25 in response to an engine drive condition. The ECU 40 energizes the secondary air pump 36 to perform a secondary air supply operation in order to activate the catalyst 31 in an earlier stage when the engine 10 is started.

In particular, the ECU 40 is equipped with a standby RAM 40*a* functioning as a backup memory which has continuously stored data therein even after the ignition switch is turned OFF. In this standby RAM 40*a*, learn values and the like are stored. These learn values and the like are properly updated, and contain shutoff pressure "P0", which is explained later. A nonvolatile memory such as an EEPROM can be alternatively employed as the backup memory.

Figure 2:
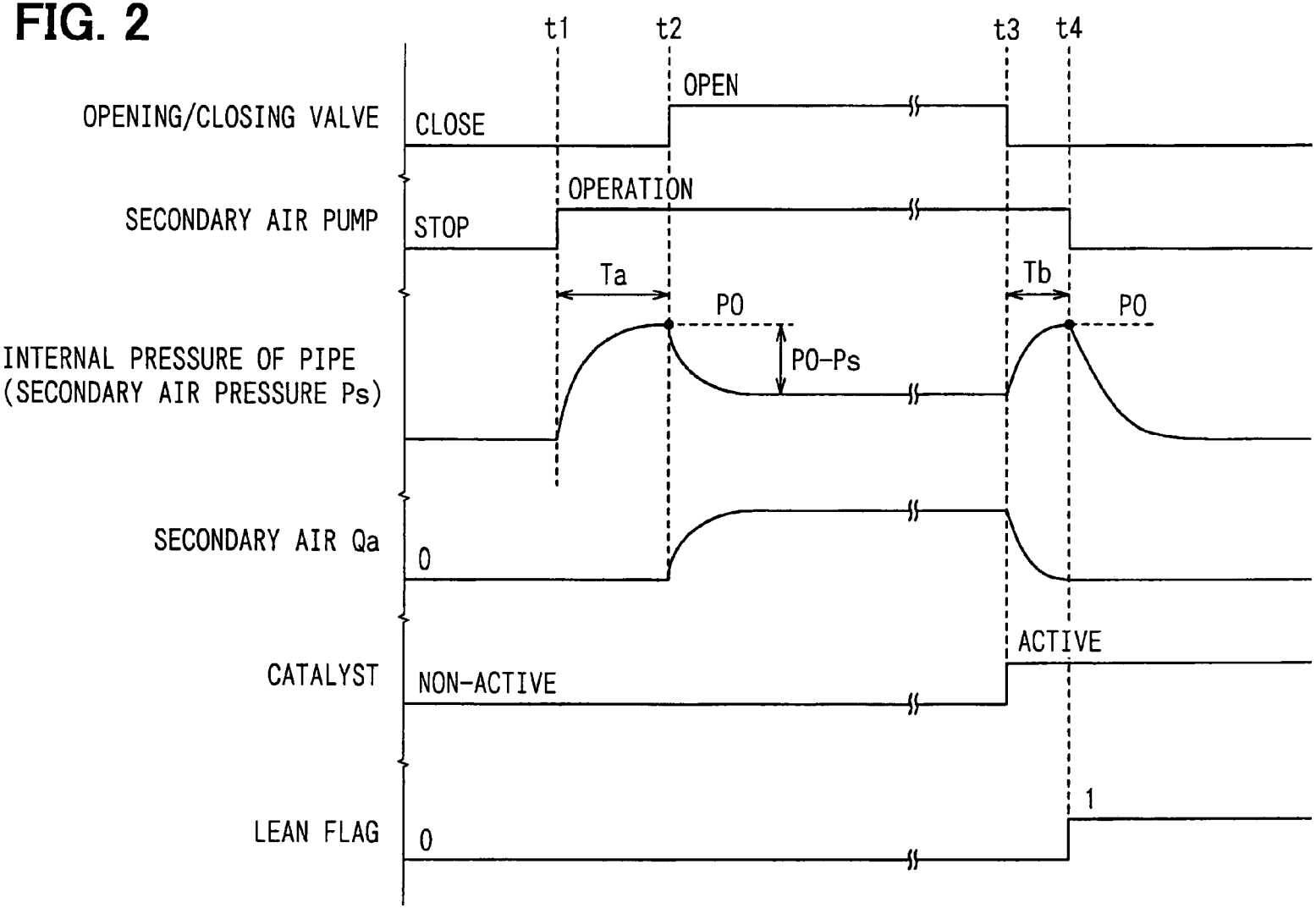
FIG. 2 is a time chart for representing a secondary air supplying operation of a secondary air supply system employed in the engine control system shown in FIG. 1.

Referring to FIG. 2, the operations of the secondary air supply system is explained hereinafter. FIG. 2 indicates a secondary air supplying operation when the engine 10 is started. It is assumed that the catalyst 31 is under non-activated condition at the starting operation of the engine 10. The secondary air supply operation is schematically explained at first. In the time chart of FIG. 2, a time period defined from "t1" to "t2" corresponds to a shutoff pressure detecting time period during which a shutoff pressure "P0" is detected in the secondary air supply system; a time period defined from "t2", to "t3" corresponds to a secondary air supply time period during which secondary air is supplied to the exhaust pipe 24; and a time period defined from "t3" to "t4" corresponds to a learning time period of the shutoff pressure "P0". The shutoff pressure "P0" corresponds to a pressure which is detected by the pressure sensor 38 when the opening/closing valve 37 is closed.

More precisely describing, at the time "t1", the operation of the secondary air pump 36 is commenced under such a condition that the opening/closing valve 37 is closed. The pressure (internal pressure of pipe) within the secondary air pipe 35 is equal to atmospheric pressure in the beginning stage, and is gradually increased after the timing "t1". Thereafter, after predetermined wait time "Ta" has passed from the timing "t1", when it becomes the timing "t2" and the internal pressure of the pipe is saturated in the predetermined shutoff pressure "P0" which is determined based upon the secondary air pump characteristic, this shutoff pressure "P0" is detected. Also, at the same timing "t2", since the opening/closing valve 37 is opened, a supply of the secondary air to the exhaust pipe 24 is commenced. In connection with the commencement of the supply of the secondary air, a secondary airflow rate "Qa" is calculated. In this first embodiment, in particular, the secondary airflow rate "Qa" is calculated based upon difference pressure ("P0"−"Ps") between the shutoff pressure "P0" detected at the timing "t2" and secondary air supply pressure "Ps" detected after the timing "t2." This calculation formula (1) is expressed as follows:

$$Qa=CA\sqrt{2(P0-Ps)/\rho} \quad (1)$$

It should be understood that in the above-described formula (1), symbol "ρ" shows fluid density; symbol "C" indicates a coefficient; and symbol "A" denotes a pipe sectional area. Since the fluid density "ρ" owns a temperature characteristic, it may be alternatively arranged that the fluid density "ρ" is corrected based upon the air intake temperature.

For instance, if such a case that the atmospheric pressure is changed (including in case that external atmospheric pressure is changed due to altitude change) is assumed, then the level of the secondary air supply pressure "Ps" is changed by the changed value of the atmospheric pressure. In this case, the shutoff pressure "P0" is similarly changed. In this case, the changed value of the atmospheric pressure can be canceled based upon the difference pressure ("P0"−"Ps") between the shutoff pressure "P0" and the secondary air supply pressure "Ps", so that the secondary airflow rate "Qa" can be calculated without being adversely influenced by the variation of the atmospheric pressure.

Thereafter, at the timing "t3", in connection with such a fact that the activation of the catalyst 31 is completed, the opening/closing valve 37 is closed, and thus, the supply of the secondary air to the exhaust pipe 24 is accomplished. After the timing "t3", the internal pressure within the pipe is gradually increased. When shutoff pressure "P0" is detected at timing "t4" after predetermined wait time "Tb" has passed from the timing t3, and also, the learn value is updated based upon this detected shutoff pressure "P0". In connection with learning of the shutoff pressure "P0", "1" is set to a learning completion flag.

Figure 3:
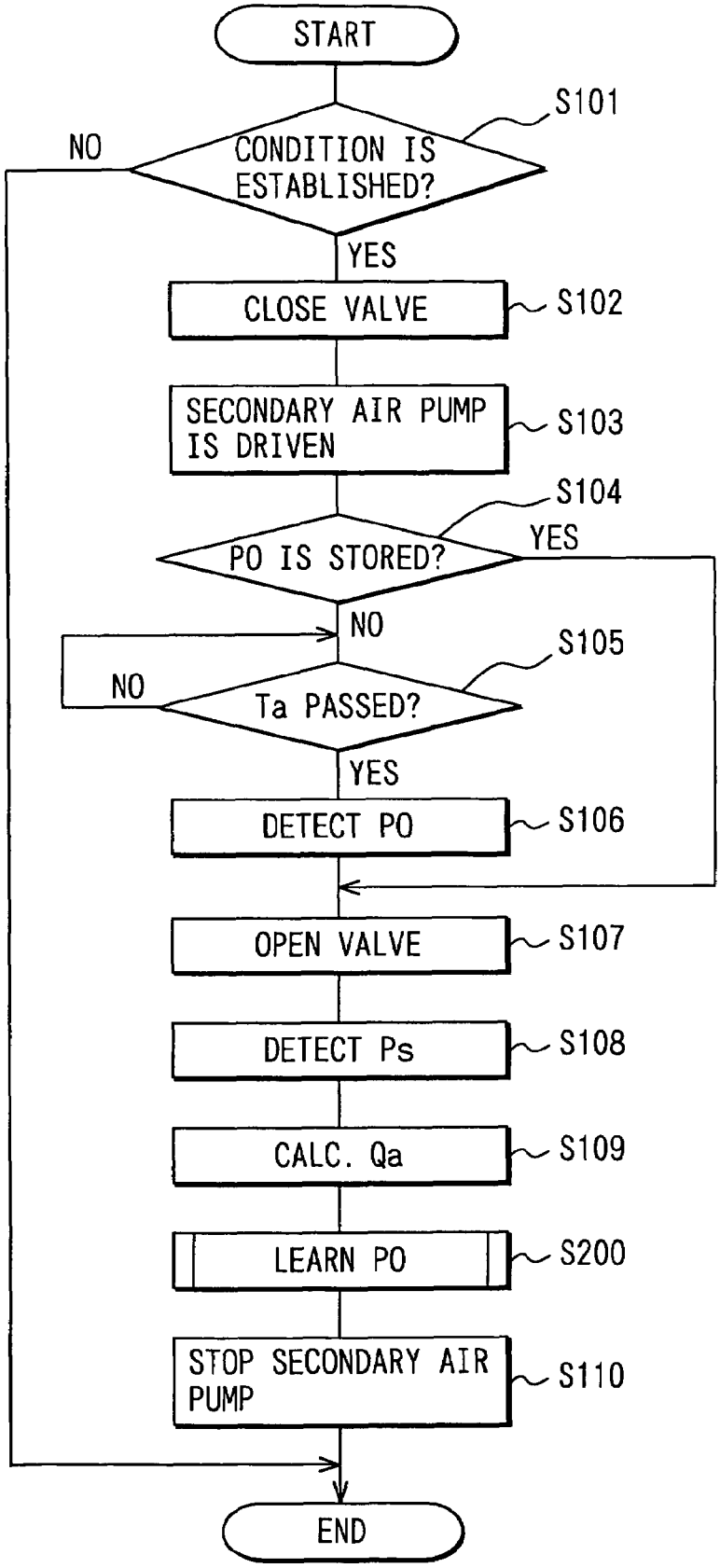
FIG. 3 is a flow chart for describing a secondary air supplying process operation of the secondary air supplying system.

FIG. 3 is a flow chart for describing a secondary air supply process operation. The secondary air supply process operation is executed by the ECU 40.

In FIG. 3, in step S101, the ECU 40 (namely, CPU) firstly determines whether an execution condition for supplying secondary air is established. For instance, in such a case that the engine 10 is under starting condition and a temperature of the cooling fluid is located within a predetermined temperature range, it is so assumed that the execution condition is established. If the execution condition is established, then the process operation is advanced to a subsequent step S102. If the execution condition is not established, then this secondary air supplying process operation is directly ended.

In step S102, the opening/closing valve 37 is closed. In the next step S103, the secondary air pump 36 is operated. Thereafter, in step S104, the ECU 40 determines whether the shutoff pressure "P0" has already been stored/held in the standby RAM 40*a* as the learn value based upon a learning completion flag, and the like. If the shutoff pressure "P0" has already been learned (namely, if learning completion flag=1), then the process operation is directly advanced to step S107. If the shutoff pressure "P0" has not yet been learned (namely, if learning completion flag=0), then shutoff pressure "P0" is detected from the detection value of the pressure sensor 38 in step S106 after the wait time "Ta" has elapsed in step S105.

Figure 6A:
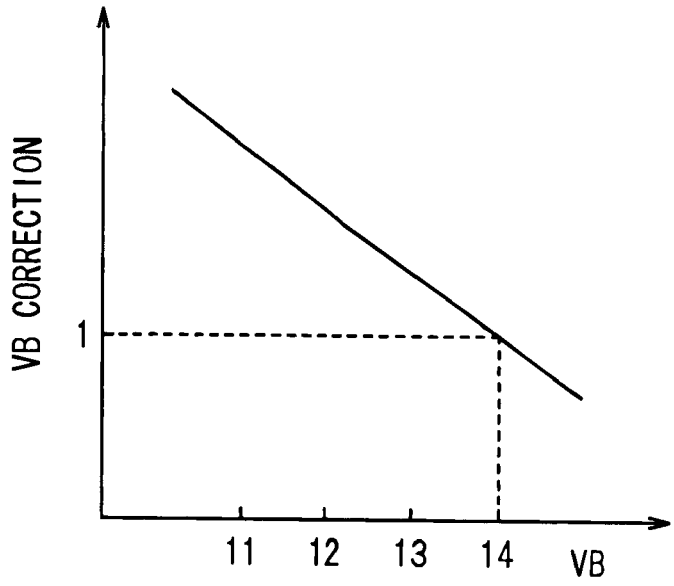
FIG. 6A is a graph showing a relationship between a battery voltage and a battery voltage correction.
Figure 6B:
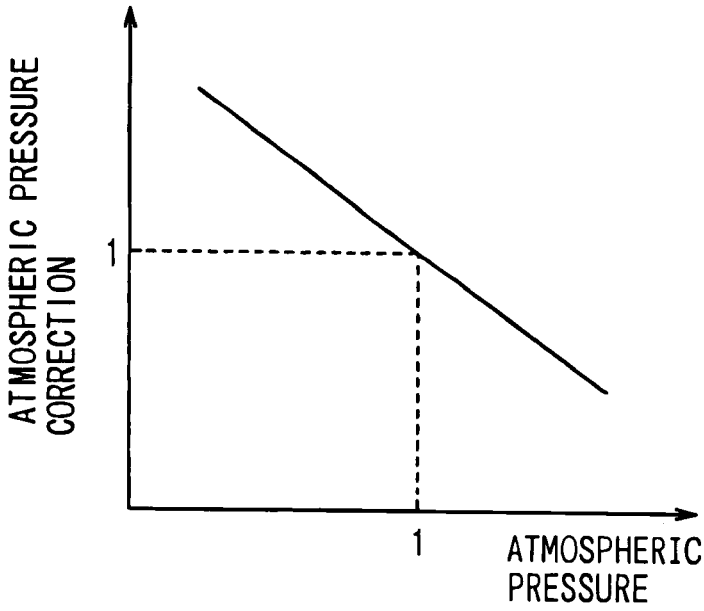
FIG. 6B are graphic diagrams showing a relationship between atmospheric pressure and an atmospheric pressure correction value.

In this case, when the shutoff pressure "P0" is detected, this detected shutoff pressure "P0" is converted into such a pressure under the condition that both the battery voltage VB and the atmospheric pressure are assumed as defined values (for example, VB=rated voltage 14 V, and atmospheric pressure=1 atm). The shutoff pressure "P0" is converted by employing correction values shown in FIG. 6A and FIG. 6B. In accordance with a VB correction value of FIG. 6A, since the battery voltage VB is lowered than the rated voltage (14 V), the shutoff pressure "P0" is corrected to the high voltage side. Also, in accordance with an atmospheric pressure correction value, since the atmospheric pressure is lowered than 1 atm, the shut off pressure "P0" is corrected to the high voltage side.

In step S107, since the opening/closing valve 37 is opened, the supply of secondary air is commenced. Thereafter, in step S108, secondary air supply pressure "Ps" is detected from the detection value of the pressure sensor 38. In step S109, a secondary airflow rate "Qa" is calculated based upon both the shutoff pressure "P0" and the secondary air supply pressure "Ps" by employing the above-described formula (1). At this time, if the shutoff pressure "P0" has been learned, the secondary airflow rate "Qa" is calculated by employing the learn value of the shutoff pressure "P0". If the shutoff pressure "P0" has not yet been learned, then the secondary airflow rate "Qa" is calculated by employing the detection value of the shutoff pressure "P0" detected in step S106. During the secondary air supply period, the process operations defined in steps S108 and S109 are continuously carried out.

When the secondary airflow rate "Qa" is calculated, in order to cancel the differences between the batteries at the shutoff pressure "P0" (otherwise, "P0" is learned) and the secondary air supply pressure "Ps" and the difference between the atmospheric pressures at the shutoff pressure "P0" and the secondary air supply pressure "Ps", the shutoff pressure "P0" acquired in step S106 is corrected based upon the battery voltage VB and the atmospheric pressure acquired time to time. This shutoff pressure "P0" obtained in step S106 implies such a shutoff pressure "P0" which has been converted to the defined valve as to the battery voltage VB and the atmospheric pressure. Alternatively, the secondary air supply pressure "Ps" is tried to be converted into such a pressure under the condition that both the battery voltage VB and the atmospheric pressure are set to the predetermined defined values (for example, VB=rated voltage (14 V), and atmospheric pressure=1 atm). In the case that the secondary air pressure value "Ps" is converted, a correction of an opposite characteristic from that of FIG. 6A and FIG. 6B may be alternatively carried out.

Thereafter, in step S200, a learning process operation of the shutoff pressure "P0" is executed. After the learning process operation of the shutoff pressure "P0" has been carried out, the operation of the secondary air pump 36 is stopped in step S110.

Figure 4:
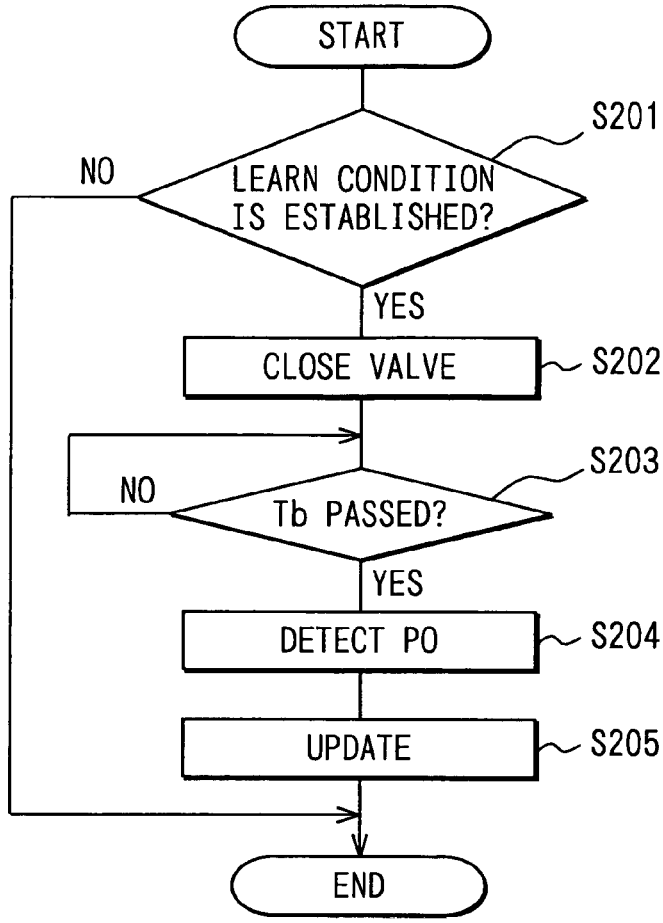
FIG. 4 is a flow chart for explaining a learning process operation of shutoff pressure executed in the engine control system.

FIG. 4 is a flowchart for representing the learning process operation of the shutoff pressure "P0". In step S201, the ECU 40 (namely, CPU) determines whether a learning start condition is established. For instance, in such a case that the activation of the catalyst 31 is completed during operation term of the secondary air pump 36, it is assumed that the learning start condition is established. If the learning start condition is established, then the learning process operation is advanced to a subsequent step S202. In step S202, the opening/closing valve 37 is closed. Then, after the wait time "Tb" has elapsed in step S203, shutoff pressure "P0" is detected from the detection value of the pressure sensor 38 in step S204. In step S205, the learn value of the standby PAM 40*a* is updated based upon the presently detected shutoff pressure "P0". Also, at this time, "1" is set to the learning completion flag in the standby RAM 40*a*.

In this process operation, at the beginning stage when the secondary air supply process operation is commenced and in the learning process operation of the shutoff pressure "P0", the learning process operation is waited for only the predetermined times "Ta" and "Tb" after the opening/closing valve 37 has been closed until the shutoff pressure "P0" is detected (namely, step S105 of FIG. 3, and step S203 of FIG. 4). A relationship between the waiting times Ta and Tb is given by Ta>Tb. In other words, as apparent from FIG. 2, at the beginning stage when the secondary air supply process operation is carried out, the internal pressure of the pipe is increased from the atmospheric pressure to the shutoff pressure "P0", whereas when the learning process operation of the shutoff pressure "P0" is carried out, the internal pressure of the pipe is increased from the secondary air supply pressure "Ps" to the shutoff pressure "P0". When these two cases are compared with each other, in the former case, the change amount of the internal pressure of the pipe is large. Also, at the beginning stage when the secondary air supply process operation is commenced, the pressure increase is delayed due to a pump rising characteristic when the power supply to the secondary air pump 36 is turned ON. Accordingly, the relationship between the waiting times Ta and Tb is set to Ta>Tb.

The secondary airflow rate "Qa" which has been calculated in the process operation of FIG. 3 is employed in an abnormal status judging operation of the secondary air supply system. In this case, the abnormal status judging process operation of the secondary air supply system will now be explained with reference to a flow chart of FIG. 5. It should be noted that this abnormal status determination process operation is executed by the ECU 40 during a secondary air supplying term (corresponding to term defined from t2 to t3 in FIG. 2).

Figure 5:
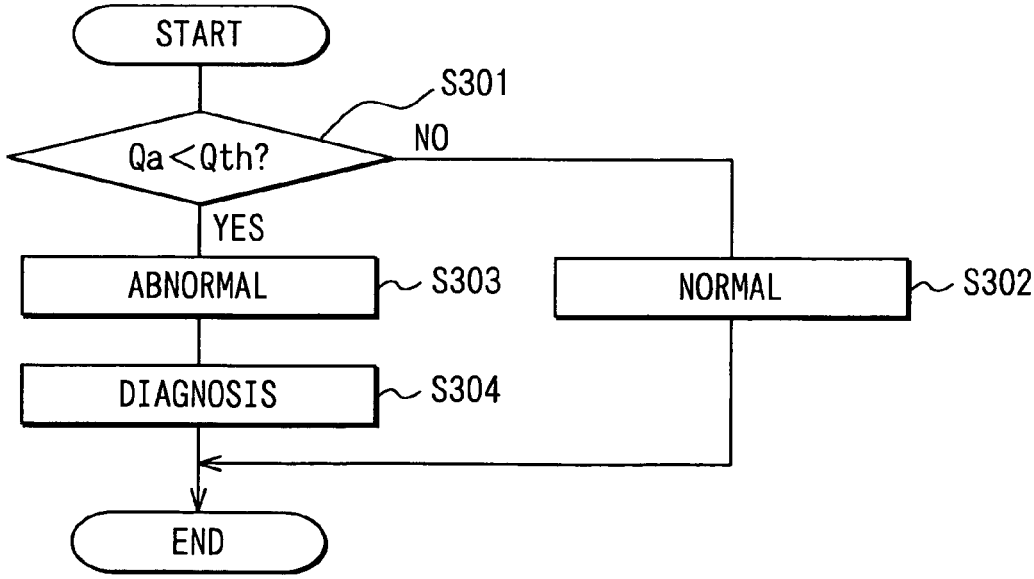
FIG. 5 is a flow chart for describing an abnormal status judging process operation executed in the engine control system.

In FIG. 5, in step S301, the ECU 40 (namely, CPU) determines whether the calculated secondary airflow rate "Qa" is smaller than a predetermined judgement value "Qth." In the case that "Qa"≧"Qth", this abnormal status determining process advances to step S302 in which the ECU 40 determines the normal status. In the case that "Qa"<"Qth", the process operation advances to step S303 in which the ECU 40 determines an abnormal status, and also, the ECU 40 executes a diagnosis process operation in the subsequent step S304. In other words, when the secondary airflow rate "Qa" is decreased, since it is conceivable that the emission exhaust amount is increased, in such a case that a predetermined amount of this secondary airflow rate "Qa" cannot be obtained, the ECU 40 determines an occurrence of an abnormal status. Diagnosis data (malfunction data) are stored in the standby RAM 40*a*, and also, a malfunction-warning lamp (MIL) is turned ON as the diagnosis process operation.

Figure 7A:
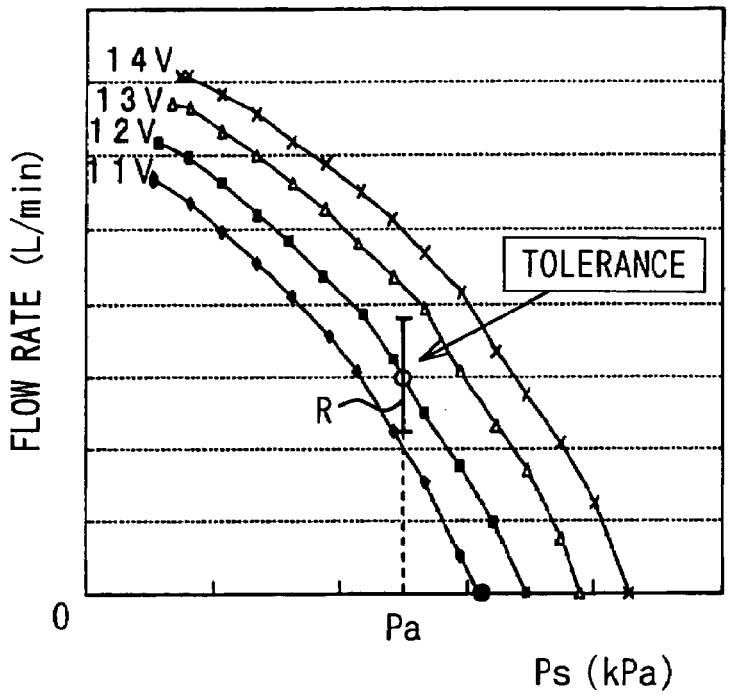
FIG. 7A and FIG. 7B are graphic diagrams for graphically indicating a relationship between an internal pressure of a pipe and a secondary airflow rate in the secondary air supply system.
Figure 7B:
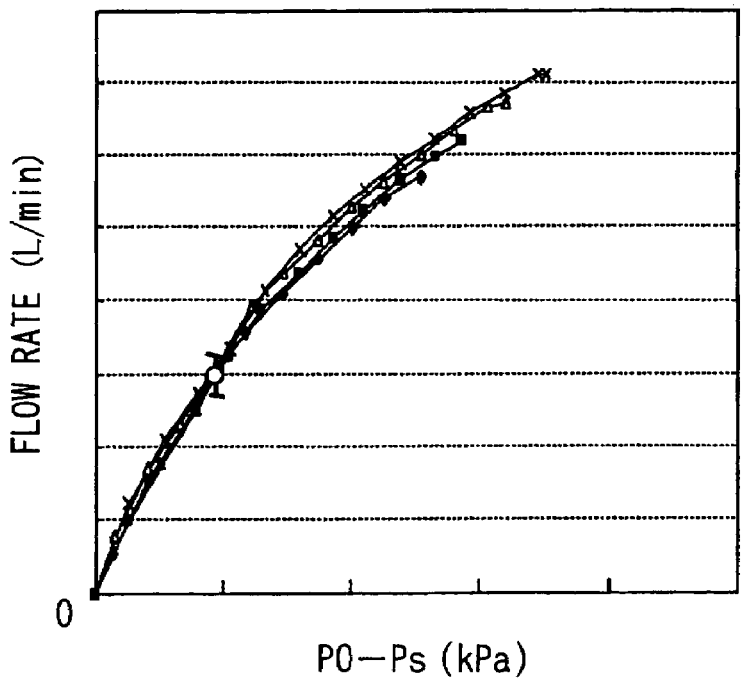

FIG. 7*a* and FIG. 7B are graphic diagrams for graphically showing a relationship between internal pressure within a pipe and a secondary airflow rate in the secondary air supply system. FIG. 7A indicates a secondary airflow rate with respect to secondary air supply pressure "Ps" as a basic flow rate characteristic in the secondary air supply system; and FIG. 7B represents a secondary airflow rate which is calculated based upon relative pressure ("P0"−"Ps") of the secondary air supply pressure.

As indicated in FIG. 7A, since the battery voltage VB is lowered with respect to the rated voltage (14 V), the flow rate characteristic is changed as illustrated in FIG. 7A. Also, while the secondary airflow rate is fluctuated due to product tolerance (for example ±30%) and the like, in such a case that the battery voltage VB and the secondary air supply pressure "Ps" are given by, for instance, VB=12V and Ps=PA, a calculation value of the secondary airflow rate is fluctuated within a range "R" in FIG. 7A. For instance, in the case that the product tolerance is equal to ±30%, the calculation precision of the secondary airflow rate is nearly equal to ±30%. As a result, there is such a problem that the secondary airflow rate cannot be correctly detected.

To the contrary, in accordance with the above-described calculation method of the secondary airflow rate according to this first embodiment, as illustrated in FIG. 7B, even when the product tolerance and the like are similarly present, the secondary airflow rate is hardly fluctuated due to the product tolerance and the like. Also, even when the battery voltage VB is varied, the flow rate characteristic is hardly changed. The Inventors of the invention could confirm that the calculation precision of the secondary airflow rate could be suppressed lower than, or equal to 5%.

In accordance with the first embodiment, the below-mentioned superior effects can be achieved.

Since the secondary airflow rate "Qa" is calculated based upon the difference pressure ("P0"−"Ps") between the shutoff pressure "P0" and the secondary air supply pressure "Ps", even when the atmospheric pressure is varied, the secondary airflow rate "Qa" can be calculated without being adversely influenced by this variation of the atmospheric pressure. Also, even when the secondary air pump 36 and the pressure sensor 38 own the product tolerance and the like, or even when the pressure loss is produced in the secondary air pipe 35, the calculation precision of the secondary airflow rate "Qa" can be increased. More specifically, although it is practically difficult to correct the calculation error due to the product tolerance and the pipe pressure loss, the above-described calculation error can be solved while the difficult error correction is not forcibly carried out in this first embodiment. As previously explained, since the secondary airflow rate "Qa" can be calculated in higher precision, this secondary airflow rate calculation method can contribute the improvement in the exhaust emission.

While the shutoff pressure "P0" has been stored in the standby RAM 40*a* as the learn value, since the secondary airflow rate "Qa" is calculated by employing this stored learn value, it is unnecessary to detect the shutoff pressure "P0" before the supply of the secondary air is commenced.

The calculation of the secondary airflow rate "Qa" can be commenced at an earlier stage after the engine 10 is started, or the like.

After the activation of the catalyst 31 is accomplished and the supply of the secondary air is accomplished, the shutoff pressure "P0" is learned. As a result, the learning operation of the shutoff pressure "P0" can be carried out without being influenced by the supply of the secondary air. Also, since there is a temporal margin, the shutoff pressure "P0" can be firmly detected, and then, can be stored as the learn value.

Since both the shutoff pressure "P0" and the secondary air supply pressure "Ps" are corrected in response to the battery voltage VB, even if the battery voltages VB when the shutoff pressure "P0" is detected and when the secondary air supply pressure "Ps" is detected are different, the difference can be corrected and therefore the flow rate can be detected in higher precision.

Since the secondary airflow rate "Qa" can be calculated in higher precision as described above, the occurrence of such an abnormal status as lowering of the pumping performance of the secondary air pump 36 and the increase of the pipe pressure loss can be detected in higher precision.

Second Embodiment

Next, in a second embodiment of the invention, a description is made of a control operation as to a fuel injection amount, while the secondary airflow rate "Qa" calculated in the above-described manner is employed, and this calculated secondary air rate "Qa" is reflected. In summary, in order that the catalyst 31 is activated in an earlier stage by supplying secondary air, for instance, an air-fuel ratio of an entrance of the catalyst 31 may be set to be a little lean. When the secondary air is supplied, a fuel injection amount control operation is carried out while the little lean air-fuel ratio is set as a target air-fuel ratio. In this case, assuming now that the air-fuel ratio is expressed by an air excess rate "λ"; an air-fuel ratio (combustion air-fuel ratio) of combustion gas used to be combustible in an engine combustion chamber is defined as "λ1"; an air-fuel ratio of an entrance of the catalyst 31 is defined as "λ2"; and an air intake amount sucked to the engine 10 is defined as "ga"; and also, a secondary airflow rate is defined as "gsai", the air-fuel ratios are given by the below-mentioned formula (2). It should also be noted that symbols "ga" and "gsai" are commonly mass flow rates. In particular, symbol "gsai" implies that the above-described secondary airflow rate "Qa" is mass-converted.

$$\lambda 1=(\lambda 2\times ga)/(ga+gsai) \quad (2)$$

An inverse number of the air-fuel ratio λ1 (air excess rate) corresponds to a fuel excess rate, and this fuel excess rate (1/λ1) becomes a fuel increase amount correction coefficient, which is referred to as "secondary air-purpose correction coefficient fsai" hereinafter, when the secondary air is supplied. In other words, in the case that the air-fuel ratio λ2 of the catalyst entrance is equal to the target air-fuel ratio λtg, the below-mentioned formula (3) is obtained by the above-explained formula (2):

$$fasi=(1/\lambda tg)\times\{(gsai+ga)/ga\} \quad (3)$$

In accordance with the above-described formula (3), the secondary air-purpose correction coefficient "fsai" may be calculated from the secondary airflow rate "gsai", the intake air amount "ga", and the target air-fuel ratio "λtg" when the secondary air is supplied.

Figure 8:
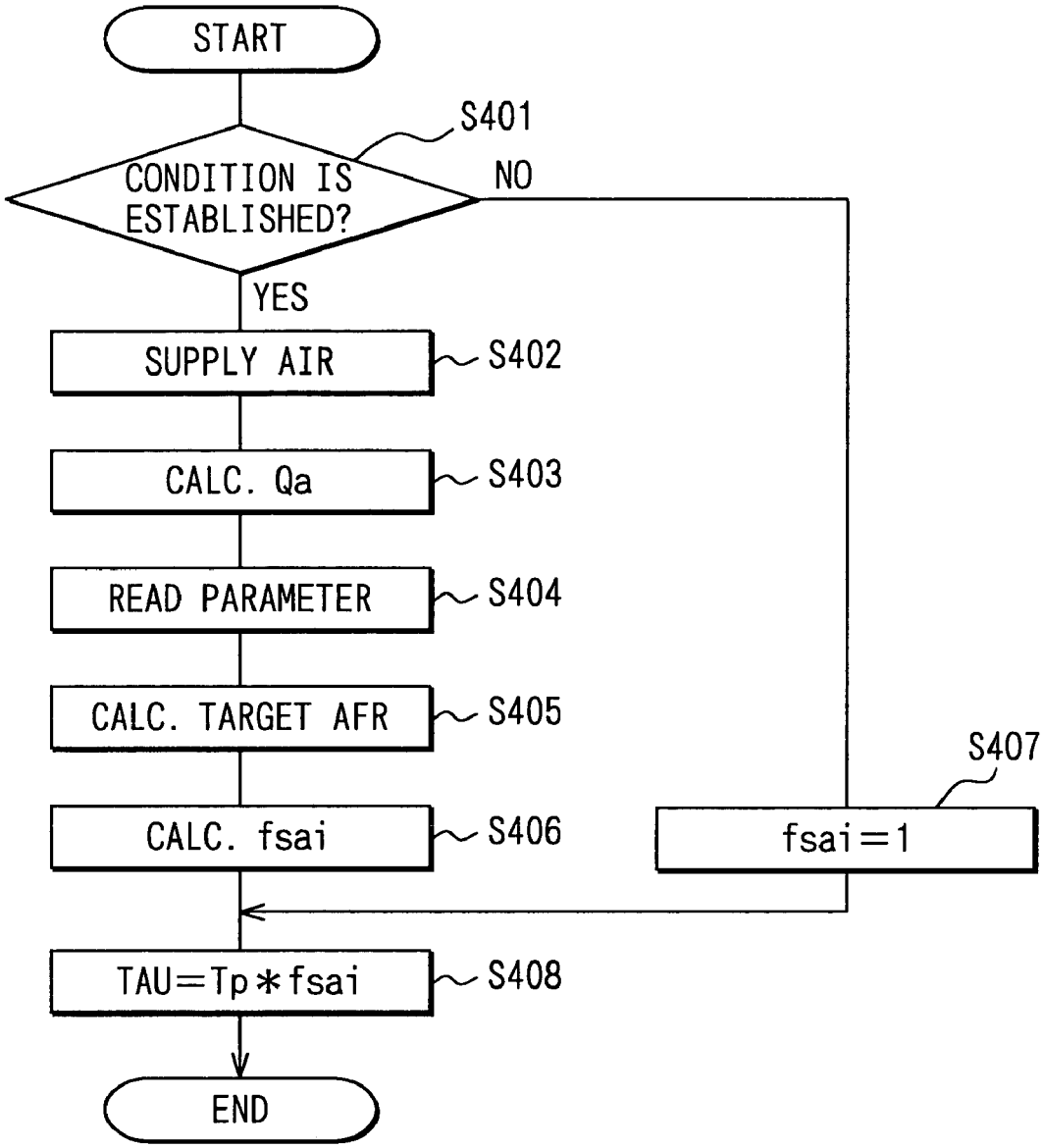
FIG. 8 is a flow chart for describing a fuel injection amount calculating process operation executed in the engine control system.

FIG. 8 is a flow chart for describing a fuel injection amount calculating process operation executed by the ECU 40. It should be noted that in FIG. 8, as to a calculation of a fuel injection amount, only a process operation related to the supply of the secondary air is indicated.

In FIG. 8, the ECU 40 firstly determines as to whether or not an execution condition of a secondary air supply is established in step S401. When the execution condition is established, the opening/closing valve 37 is opened, and also, the secondary air pump 36 is operated, so that the supply of the secondary air is commenced in step S402. Thereafter, in step S403, as previously explained, a secondary airflow rate "Qa" is calculated based upon the difference pressure between the shutoff pressure "P0" and the second air supply pressure "Ps". At this time, since the secondary airflow rate "Qa" corresponds to a volume flow rate, the volume flow rate is converted into a mass flow rate in response to air density, and the converted result is defined as "secondary airflow rate gsai."

Thereafter, in step S404, a drive condition parameter such as an engine revolution and an air intake amount is read. In step S405, while a target air-fuel ratio map prepared when the secondary air is supplied is employed, a target air-fuel ratio "λtg" is calculated based upon the engine revolution and the load acquired time to time. In step S406, a secondary air-purpose correction coefficient "fsai" is calculated based upon the secondary airflow rate "gsai", the air intake amount "ga", and the target air-fuel ratio "λtg" at this time by using the above-described formula (3).

On the other hand, in the case that the execution condition of the secondary air supply cannot be established, the process operation advances to step S407 in which the secondary air-purpose correction coefficient "fsai" is equal to "1".

After the secondary air-purpose correction coefficient "fsai" has been calculated in the above-described manner, in step S408, the basic injection amount "Tp" calculated based upon the operation condition parameter such as the engine revolution and the air intake amount is multiplied by the secondary air-purpose correction amount "fsai", and then, the multiplied result is set as a final injection amount "TAU."

In accordance with the second embodiment, the secondary air-purpose correction coefficient "fsai" is calculated by employing the secondary airflow rate "Qa" which has been calculated based upon the difference pressure between the shutoff pressure "P0" and the secondary air supply pressure "Ps". Furthermore, the fuel injection amount is corrected based upon this calculated secondary air-purpose correction coefficient "fsai." As a result, it is possible to suppress lowering of the precision for correcting the fuel, which is caused by the error component such as the product tolerance. Therefore, the fuel injection amount control operation can be realized in high precision when the secondary air is supplied.

It should be noted that the invention is not limited only to the descriptions of the above-explained embodiments, but may be realized by the following modifications.

In the above embodiments, as apparent from the time chart of FIG. 2, in the case that the learning operation of the shutoff pressure "P0" has not yet been accomplished, the shutoff pressure "P0" is detected two times when the secondary air supply operation is newly commenced and when it is accomplished. However, this structural can be changed. For instance, when the shutoff pressure "P0" is detected in the beginning stage when the second air supply operation is commenced, the learning operation may be alternatively carried out based upon this detected shutoff pressure "P0".

When the opening/closing valve 37 is closed so as to detect the shutoff pressure "P0", the wait time until the shutoff pressure "P0" is detected may be alternatively set in response to the internal pressure of the pipe when the opening/closing valve 37 is closed. In other words, the lower the internal pressure of the pipe becomes when the opening/closing valve 37 is closed, the longer the wait time is prolonged. For instance, in the case of FIG. 2, since the internal pressure of the pipe at the timing "t1" is lower than the internal pressure of the pipe at the timing "t3", the wait time relationship is given by Ta>Tb.

In the above embodiments, the secondary airflow rate "Qa" is calculated by employing the formula (above-described equation (1)). Instead of this calculation method, while a relationship between the difference pressure ("P0"–"Ps") between the shutoff pressure "P0" and the secondary air supply pressure "Ps", and the secondary airflow rate "Qa" is previously acquired to be stored in a map, or the like, such a structure may be alternatively employed by which the secondary airflow rate "Qa" may be alternatively calculated by employing this map.

Also, the shutoff pressure "P0" may be alternatively detected when the ignition is turned OFF, and then, the learn valve may be alternatively updated based upon this detected shutoff pressure "P0". For example, when the ignition is turned OFF, a so-called main relay control operation is carried out in which the supply of the electric power to the ECU 40 is continued for a predetermined time period even after this ignition is turned OFF, and a predetermined control operation is carried out. In this main relay control operation, the detecting operation and the learning operation as to the shutoff pressure "P0" may be alternatively carried out. In accordance with this structure, even when the condition change related to the secondary air supply system happens to occur for a time duration from the engine start until the engine stop, this may be alternatively reflected as the shutoff pressure learn valve.

In above embodiments, the secondary airflow rate "Qa" has been calculated based upon the difference pressure ("P0"–"Ps") between the shutoff pressure "P0" and the secondary air supply pressure "Ps". Instead of this calculation manner, the secondary airflow rate "Qa" may be alternatively calculated based upon a ratio (namely, "P0"/"Ps") of the shutoff pressure "P0" to the secondary air supply pressure "Ps". In this alternative case, the secondary airflow rate may be calculated in higher precision irrespective of the product tolerance and the like.

Alternatively, a base secondary airflow rate may be calculated based upon the secondary air supply voltage "Ps", and also, a flow rate calculation value may be calculated in response to the shutoff pressure "P0". Then, the calculated base secondary airflow rate may be corrected based upon the flow rate correction value so as to calculate the secondary airflow rate "Qa". For example, the higher the shutoff pressure "P0" becomes, the smaller the flow rate correction value is decreased. Even in this structure, the secondary airflow rate may be alternatively calculated in higher precision without being adversely influenced by the variation of atmospheric pressure, the product tolerance, and the like.

In the above-described embodiments, while the shutoff pressure "P0" is detected as "reference pressure", the secondary airflow rate "Qa" is calculated based upon the difference pressure ("P0"–"Ps") between the shutoff pressure "P0" and the secondary air supply voltage "Ps". Alternatively, the reference pressure may be changed by any pressure other than the shutoff pressure "P0". For example, such an internal pressure of the pipe detected when the opening/closing valve 37 is closed and the secondary air pump 36 is operated under such an operation condition different from the operation condition under normal operation may be alternatively employed as the reference pressure. Also an internal pressure of the pipe detected when the secondary air pump 36 is operated and when the opening/closing valve 37 is opened with a predetermined degree may be employed as the reference pressure. In summary, the secondary airflow rate "Qa" may be alternatively calculated by employing both the reference pressure and the secondary air operation pressure "Ps", which are detected by the pressure sensor 38 under such a condition which is different from the normal secondary air supply condition.

In the above-described second embodiment, when the secondary air is supplied, the fuel injection amount control operation is carried out while the weak lean air-fuel ratio is set as the target air-fuel ratio. Alternatively, this target air-fuel ratio may be alternatively substituted by a stoichiometric air-fuel ratio.

Third Embodiment

In a third embodiment of the invention, more specifically, when a secondary air supply control operation is carried out, a secondary airflow rate "Qa" is calculated based upon both pressure within the secondary air pipe 35 (will be referred to as "secondary air supply pressure Ps" hereinafter) which is sensed by the pressure sensor 38, and pressure within the exhaust pipe 24 (will be referred to as "exhaust pressure Pex" hereinafter) which is predicted from an engine drive condition and the like. This calculation equation is given as the following equation (4):

$$Qa=CA\sqrt{2(Ps-Pex)/\rho} \tag{4}$$

It should be understood that in the above-described equation (4), symbol "ρ" shows fluid density; symbol "C" indicates a coefficient; and symbol "A" denotes a pipe sectional area of the secondary air pipe 35. Since the fluid density "ρ" owns a temperature characteristic, it may be alternatively arranged that the fluid density "ρ" is corrected based upon the intake temperature.

In the exhaust pipe 24, the exhaust pressure "Pex" is changed in response to a drive condition of the engine 10 and the like, and then, the secondary airflow rate "Qa" is varied in conjunction with the change of this exhaust pressure "Pex." In this case, in accordance with the above-described equation (4), even when the exhaust pressure "Pex" is changed, the secondary airflow rate "Qa" can be correctly calculated.

Figure 9:
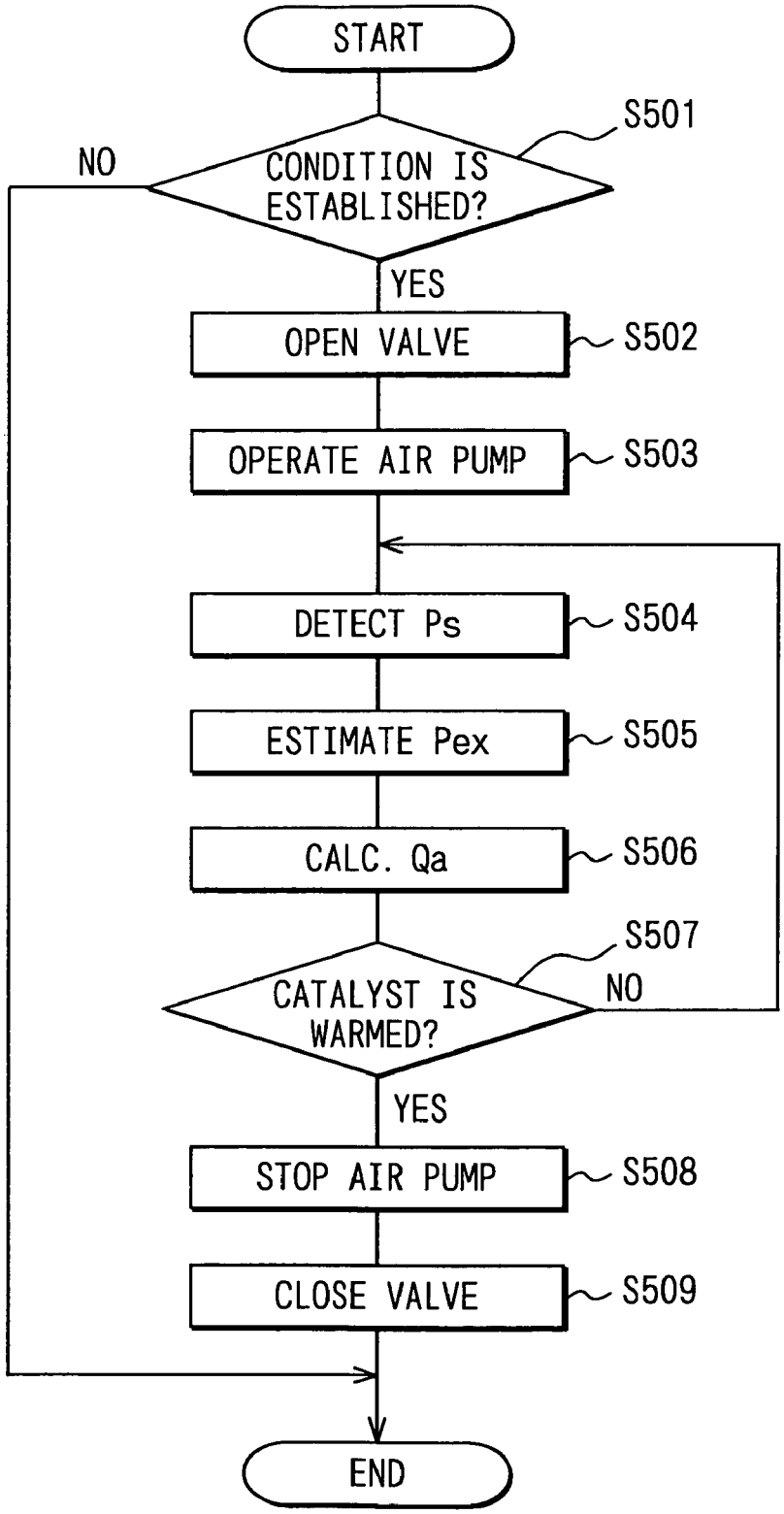
FIG. 9 is a flow chart for describing a secondary air supply process operation executed in an engine control system according to a second embodiment of the invention.

Next, a secondary air supply process operation executed by the ECU 40 will now be explained. FIG. 9 is a flow chart for describing the secondary air supply process operation. This secondary air supply process operation is executed by the ECU 40.

In FIG. 9, in step S501, the ECU 40 (namely, CPU) firstly determines as to whether or not an execution condition for supplying secondary air is established. For instance, in such a case that the engine 10 is under starting condition and a temperature of the cooling fluid is located within a predetermined temperature range, it is so assumed that the execution condition is established. If the execution condition is established, then the process operation is advanced to a subsequent step S502. If the execution condition is not established, then this secondary air supplying process operation is directly ended.

In step S502, the opening/closing valve 37 is opened, and in the subsequent step S503, the secondary air pump 36 is operated. As a result, the supply of the secondary air is commenced. Thereafter, in step S504, secondary air supply pressure "Ps" is detected from a detection signal of the pressure sensor 38. In step S505, exhaust pressure "Pex" is predicted based upon the engine drive condition and the like time to time. Concretely speaking, for example, the exhaust pressure "Pex" is predicted based upon either the air intake amount or the intake pipe pressure. Alternatively, while a pressure sensor is provided in the exhaust pipe 24, exhaust pressure detected by this pressure sensor may be alternatively set as the exhaust pressure "Pex." Thereafter, in step S506, a secondary airflow rate "Qa" is calculated based upon both the secondary air supply pressure "Ps" and the exhaust pressure "Pex" by using the above-explained equation (4).

Thereafter, in step S507, the ECU 40 determines as to whether or not a warming operation of the catalyst 31 is accomplished. When the warming operation is not yet accomplished, the process operation is returned back to the previous step S504. In this step S504, the secondary air supply pressure "Ps" is detected; the exhaust pressure "Pex" is predicted; and the secondary airflow rate "Qa" is calculated (steps S504 to S506). Then, when the warming operation of the catalyst 31 is accomplished, the process operation is advanced to step S508. In this step S508, the secondary air pump 36 is stopped. In the subsequent step S509, the opening/closing valve 37 is closed. As a result, the supply of the secondary air is ended.

The secondary airflow rate "Qa" which has been calculated in the above-described manner is employed in an abnormal status judging operation of the secondary air supply system. In this case, the abnormal status judging process operation of the secondary air supply system will now be explained with reference to a flowchart of FIG. 10. It should be noted that this abnormal status determination process operation executed by the ECU 40 during a secondary air supplying term.

Figure 10:
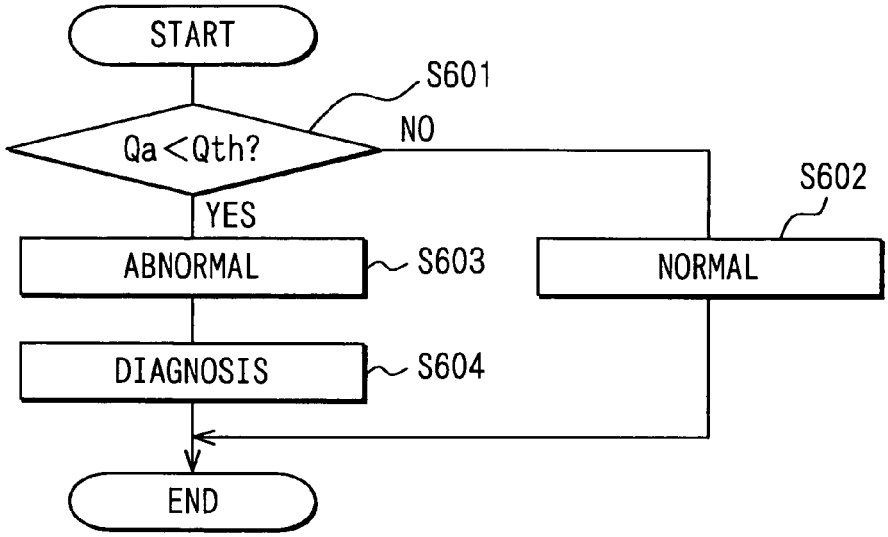
FIG. 10 is a flow chart for describing an abnormal status judging process operation executed in the engine control system of FIG. 9.

In FIG. 10, in step S601, the ECU 40 (namely, CPU) determines as to whether or not the calculated secondary airflow rate "Qa" is smaller than a predetermined judgement value "Qth." In the case that "Qa"≧"Qth", this abnormal status judging process operation is advanced to step S602 in which the ECU 40 determines the normal status. In the case that "Qa"<"Qth", the process operation is advanced to step S603 in which the ECU 40 determines an abnormal status, and also, the ECU 40 executes a diagnosis process operation in the subsequent step S604. In other words, when the secondary airflow rate "Qa" is decreased, since it is conceivable that the emission exhaust amount is increased, in such a case that a predetermined amount of this secondary airflow rate "Qa" cannot be obtained, it is so assumed that the ECU 40 determines the occurrence of the abnormal status. Concretely, speaking, diagnosis data (malfunction data) is stored in the standby RAM 40*a*, and also, a malfunction-warning lamp (MIL) is turned ON as the diagnosis process operation.

In accordance with this third embodiment which has been described in detail, not only the secondary air supply pressure "Ps", but also the exhaust pressure "Pex" are employed so as to calculate the secondary airflow rate "Qa." As a result, even when the exhaust pressure "Pex" is changed due to such a factor that the engine drive condition is changed, the secondary airflow rate "Qa" can be calculated in higher precision. As a consequence, the exhaust emission may be improved. In this case, in particular, the difference pressure ("Ps"−"Pex") between the secondary air supply pressure "Ps" and exhaust pressure "Pex" is employed as the calculation parameter of the secondary airflow rate, and therefore even when the pressure level is changed due to such a factor as a variation in the atmospheric pressure, the secondary airflow rate "Qa" can be calculated without being adversely influenced by this variation of the atmospheric pressure.

Fourth Embodiment

Next, in a fourth embodiment of the invention, a description is made of a control operation as to a fuel injection amount, while the secondary airflow rate "Qa" calculated in the above-described manner is employed, and this calculated secondary air rate "Qa" is reflected. In summary, in order that the catalyst 31 is activated in an earlier stage by supplying secondary air, for instance, an air-fuel ratio of an entrance of the catalyst 31 may be set to be weak lean. When the secondary air is supplied, a fuel injection amount control operation is carried out while this weak lean air-fuel ratio is set as a target air-fuel ratio. In this case, assuming now that the air-fuel ratio is expressed by an air excess rate "λ"; an air-fuel ratio (combustion air-fuel ratio) of combustion gas used to be combustible in an engine combustion chamber is defined as "λ1"; an air-fuel ratio of an entrance of the catalyst 31 is defined as "λ2"; and an air intake amount sucked to the engine 10 is defined as "ga"; and also, a secondary airflow rate is defined as "gsai", the air-fuel ratios are given by the below-mentioned formula (5). It should also be noted that symbols "ga" and "gsai" are commonly mass flow rates. In particular, symbol "gsai" implies that the above-described secondary airflow rate "Qa" is mass-converted.

$$\lambda 1=(\lambda 2\times ga)/(ga+gsai) \tag{5}$$

An inverse number of the air-fuel ratio λ1 (air excess rate) corresponds to a fuel excess rate, and this fuel excess rate (1/λ1) becomes a fuel increase amount correction coefficient (will be referred to as "secondary air-purpose correction coefficient fsai" hereinafter) when the secondary air is supplied. In other words, in the case that the air-fuel ratio λ2 of the catalyst entrance is equal to the target air-fuel ratio λtg, the below-mentioned formula (6) is obtained by the above-explained formula (5):

$$fsai=(1/\lambda tg)\times\{(gsai+ga)/ga\} \tag{6}$$

In accordance with the above-described formula (6), the secondary air-purpose correction coefficient "fsai" may be calculated from the secondary airflow rate "gsai", the intake air amount "ga", and the target air-fuel ratio "λtg" when the secondary air is supplied.

Figure 11:
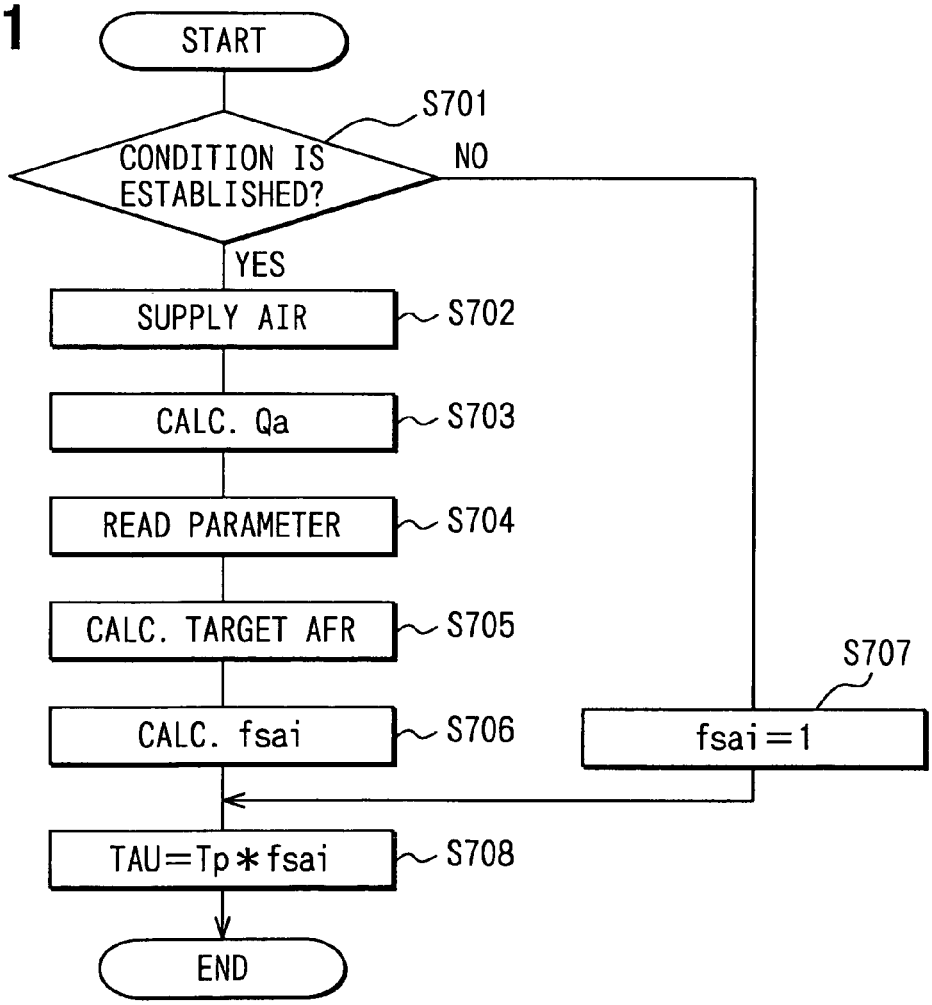
FIG. 11 is a flow chart for indicating a fuel injection amount calculating process operation executed in the engine control system of FIG. 9.

FIG. 11 is a flow chart for describing a fuel injection amount calculating process operation executed by the ECU 40. It should be noted that in FIG. 11, as to a calculation of a fuel injection amount, only a process operation related to the supply of the secondary air is indicated.

In FIG. 11, the ECU 40 firstly determines as to whether or not an execution condition of a secondary air supply is established in step S701. When the execution condition is established, the opening/closing valve 37 is opened, and also, the secondary air pump 36 is operated, so that the supply of the secondary air is commenced in step S702. Thereafter, in step S703, as previously explained, a secondary airflow rate "Qa" is calculated based upon the difference pressure between the shutoff pressure "P0" and the second air supply pressure "Ps". At this time, since the secondary airflow rate "Qa" corresponds to a volume flow rate, the volume flow rate is converted into a mass flow rate in response to air density, and the converted result is defined as "secondary airflow rate gsai."

Thereafter, in step S704, a drive condition parameter such as an engine revolution and an air intake amount is read. In step S705, while a target air-fuel ratio map prepared when the secondary air is supplied is employed, a target air-fuel ratio "λtg" is calculated based upon the engine revolution and the load acquired time to time. In step S706, a secondary air-purpose correction coefficient "fsai" is calculated based upon the secondary airflow rate "gsai", the air intake amount "ga", and the target air-fuel ratio "λtg" at this time by using the above-described formula (6).

On the other hand, in the case that the execution condition of the secondary air supply cannot be established, the process operation is advanced to step S707 in which the secondary air-purpose correction coefficient "fsai" is equal to "1."

After the secondary air-purpose correction coefficient "fsai" has been calculated in the above-described manner, in step S708, the basic injection amount "Tp" calculated based upon the operation condition parameter such as the engine revolution and the air intake amount is multiplied by the secondary air-purpose correction amount "fsai", and then, the multiplied result is set as a final injection amount "TAU."

In accordance with the fourth embodiment, the secondary air-purpose correction coefficient "fsai" is calculated by employing the secondary airflow rate "Qa" which has been calculated based upon the difference pressure between the exhaust pressure Pex and the secondary air supply pressure "Ps". Furthermore, the fuel injection amount is corrected based upon this calculated secondary air-purpose correction coefficient "fsai." As a result, it is possible to suppress lowering of the precision as to the fuel correction, which is caused by the change in the exhaust pressure "Pex". Therefore, the fuel injection amount control operation can be realized in high precision when the secondary air is supplied.

It should be noted that the invention is not limited only to the descriptions of the above-explained embodiments, but may be realized by the following modifications.

In the above-described embodiments, the secondary airflow rate "Qa" is calculated by employing the above-described formula (4) based upon the difference pressure ("Ps"−"Pex") between the secondary air supply pressure "Ps" and the exhaust pressure "Pex". Instead of this calculation method, while a relationship among the exhaust pressure "Pex", the secondary airflow rate "Qa" and the secondary air supply pressure "Ps" is previously acquired to be stored in a map, or the like, such a structure may be alternatively employed by which the secondary airflow rate "Qa" may be calculated by employing this map. Also, instead of the difference pressure ("Ps"−"Pex") between the secondary air supply pressure "Ps" and the exhaust pressure "Pex", the secondary airflow rate "Qa" may be alternatively calculated based upon a pressure ratio ("Ps"/"Pex") of the secondary air supply pressure "Ps" to the exhaust pressure "Pex". Even in such an alternative case, the secondary airflow rate "Qa" may be calculated in higher precision.

Figure 12:
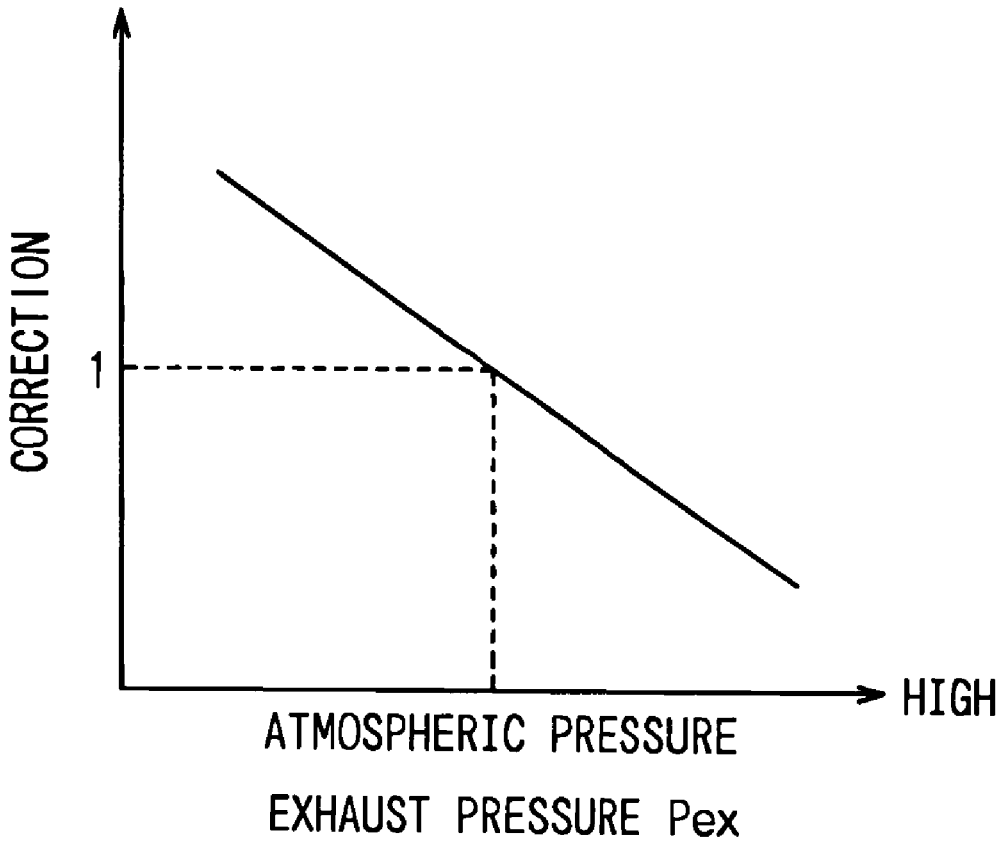
FIG. 12 is a characteristic diagram for determining a flow rate correction value of the engine control system of FIG. 9.

Alternatively, a base airflow rate may be calculated based upon the secondary air supply pressure "Ps", a flow rate correction value may be calculated in response to the exhaust pressure "Pex", and then, the calculated base airflow rate may be corrected based upon this calculated flow rate correction value so as to calculate the secondary airflow rate "Qa". For instance, the flow rate correction value may be determined by using the relationship shown in FIG. 12. The higher the exhaust pressure "Pex" is increased, the smaller the flow rate correction value is decreased. Also, in this arrangement, the secondary airflow rate "Qa" can be calculated in higher precision.

As the parameter for calculating the secondary airflow rate "Qa", the exhaust flow rate may be alternatively employed instead of the exhaust pressure. In other words, the secondary airflow rate "Qa" may be alternatively calculated based upon both the secondary air supply pressure and the exhaust flow rate. The exhaust flow rate may be alternatively detected by employing a flow rate sensor, or may be alternatively predicted based upon an engine drive condition.

The opening/closing valve 37 provided in the secondary air pipe 35 can be alternatively substituted by a flow rate control valve in which the flow rate may be adjusted in a linear mode. Then, when the secondary air is supplied, an open degree of this flow rate control valve may be alternatively controlled in such a manner that a secondary airflow rate acquired time to time may become a target value.

In the above-described fourth embodiment, when the secondary air is supplied, the fuel injection amount control operation is carried out while the a little lean air-fuel ratio is set as the target air-fuel ratio. Alternatively, this target air-fuel ratio may be alternatively substituted by a stoichiometric air-fuel ratio.

What is claimed is:

1. A secondary air supply system of an internal combustion engine comprising:

an exhaust gas purifying apparatus provided in an exhaust passage of the internal combustion engine;

a secondary air supplying apparatus for supplying secondary air via a secondary air passage to an upstream side of the exhaust gas purifying apparatus;

an opening/closing valve provided in the secondary air passage, for opening and closing the secondary air passage;

a pressure sensor provided between the secondary air supply apparatus and the opening/closing valve in the secondary air passage, for detecting pressure within the secondary air passage;

flow rate calculating means for calculating a secondary airflow rate based upon both secondary air supply pressure, which is detected by the pressure sensor under a predetermined secondary air supply condition that the secondary air supply apparatus is operated and the opening/closing valve is opened, and reference pressure which is detected by the pressure sensor under different condition from the predetermined secondary air supply condition; and learning means for storing the reference pressure detected under the different condition from the secondary air supply condition into a backup-purpose memory as a reference pressure learn value;

wherein the flow rate calculating means calculates the secondary airflow rate by employing the reference pressure learn value stored in the backup-purpose memory, wherein when the learning means stores the reference pressure into the backup-purpose memory as the reference pressure learn value, the learning means converts the reference pressure into pressure under such a condition that both a power supply voltage of the secondary air supply apparatus and atmospheric pressure are set to predetermined defined values so as to calculate the reference pressure learn value; and wherein the flow rate calculating means corrects the reference pressure learn value based upon both a power supply voltage and atmospheric pressure acquired time to time, calculates the secondary airflow rate, or converts the secondary air supply pressure into pressure under such a condition that both the power supply voltage of the secondary air supply apparatus and atmospheric pressure are set to the predetermined defined values, and calculates the secondary airflow rate.

2. A secondary air supply system of an internal combustion engine according to claim 1, wherein the flow rate calculating means calculates the secondary airflow rate based upon difference pressure between the secondary air supply pressure and the reference pressure.

3. A secondary air supply system of an internal combustion engine according to claim 1, wherein the flow rate calculating means calculates a base secondary airflow rate based upon the secondary air supply pressure, calculates a flow rate correction value in response to the reference pressure, and corrects the calculated base secondary airflow rate based upon the flow rate correction value so as to calculate the secondary airflow rate.

4. A secondary air supply system of an internal combustion engine according to claim 1, wherein a correction is carried out for at least one of the reference pressure, the secondary air supply pressure, and the secondary airflow rate in response to differences between both a power supply voltage of the secondary air supply apparatus and atmospheric pressure when the reference pressure is detected, and both a power supply voltage of the secondary air supply apparatus and atmospheric pressure when the secondary air supply pressure are detected.

5. A secondary air supply system of an internal combustion engine according to claim 1, further comprising:

abnormal status detecting means for detecting an abnormal status of the secondary air supply apparatus based upon the secondary airflow rate calculated by the flow rate calculating means.

6. A fuel injection amount control apparatus of an internal combustion engine, to which the secondary air supply system recited in claim 1 has been applied, comprising:

target air-fuel ratio setting means for setting a target air-fuel ratio when the secondary air is supplied to the exhaust gas purifying apparatus; and fuel amount correcting means for correcting a fuel injection amount injected to the internal combustion engine based upon the target air-fuel ratio set by the target air-fuel ratio setting means when the secondary air is supplied, the secondary airflow rate calculated by the flow rate calculating means, and an intake air amount sucked to the internal combustion engine.

7. A fuel injection amount control apparatus of an internal combustion engine according to claim 6, wherein the fuel amount correcting means calculates an increased amount correcting amount used when the secondary air is supplied based upon the target air-fuel ratio when the secondary air is supplied, and a change in the secondary airflow rates with respect to the air intake amount of the internal combustion engine, and then, corrects the fuel injection amount based upon the calculated increased amount correcting amount.

8. A fuel injection amount control apparatus of an internal combustion engine according to claim 6, wherein the target air-fuel ratio setting means sets the target air-fuel ratio in such a manner that an air-fuel ratio of an entrance port of the exhaust gas purifying apparatus when the secondary air is supplied is turned into a stoichiometric air-fuel ratio, or becomes leaner than the stoichiometric air-fuel ratio.

9. A secondary air supply system of an internal combustion engine comprising:

an exhaust gas purifying apparatus provided in an exhaust passage of the internal combustion engine;

a secondary air supplying apparatus for supplying secondary air via a secondary air passage to an upstream side of the exhaust gas purifying apparatus;

an opening/closing valve provided in the secondary air passage, for opening and closing the secondary air passage;

a pressure sensor provided between the secondary air supply apparatus and the opening/closing valve in the secondary air passage, for detecting pressure within the secondary air passage;

flow rate calculating means for calculating a secondary airflow rate based upon both secondary air supply pressure, which is detected by the pressure sensor under a predetermined secondary air supply condition that the secondary air supply apparatus is operated and the opening/closing valve is opened, and reference pressure which is detected by the pressure sensor under different condition from the predetermined secondary air supply condition; and wherein a shutoff pressure detected by the pressure sensor when the secondary air supply apparatus is operated and the opening/closing valve is closed is defined as the reference pressure;

wherein said learning means stores shutoff pressure into a backup-purpose memory as a shutoff pressure learn value, the shutoff pressure being detected by the pressure sensor when the opening/closing valve is closed under such a condition that the secondary air supply apparatus is operated;

wherein the flow rate calculating means calculates the secondary airflow rate by employing the shutoff pressure learn value stored in the back-up purpose memory;

wherein when the learning means stores the shutoff pressure into the backup-purpose memory as the shutoff pressure learn value, the learning means converts the shutoff pressure into pressure under such a condition that both a power supply voltage of the secondary air supply apparatus and atmospheric pressure are set to predetermined defined values so as to calculate the shutoff pressure learn value; and wherein the flow rate calculating means corrects the shutoff pressure learn value based upon both a power supply voltage and atmospheric pressure acquired time to time, and thereafter, calculates the secondary airflow rate, or converts the secondary air supply pressure into pressure under such a condition that both the power supply voltage of the secondary air supply apparatus and atmospheric pressure are set to the predetermined defined values, and calculates the secondary airflow rate.

10. A secondary air supply system of an internal combustion engine according to claim 9, wherein after the opening/closing valve is closed under such a condition that the secondary air supply apparatus is operated, when predetermined wait time has passed, the shutoff pressure is detected.

11. A secondary air supply system of an internal combustion engine according to claim 9, wherein after the opening/closing valve is closed so as to accomplish the supply of the secondary air to the exhaust passage, the learning means subsequently performs an updating operation of the shutoff learn value.

12. A secondary air supply system of an internal combustion engine according to claim 11, wherein after the opening/closing valve is closed when the supply of the secondary air is accomplished, when predetermined wait time has elapsed, the shutoff pressure is detected.

* * * * *